US012053107B2

(12) United States Patent
Bouan et al.

(10) Patent No.: US 12,053,107 B2
(45) Date of Patent: Aug. 6, 2024

(54) SYSTEM FOR PRESENTATION OF SELF-SERVICE ITEMS

(71) Applicant: Fors France, Champigny sur Marne (FR)

(72) Inventors: Bruno Bouan, La Varenne Saint Hilarie (FR); Olivier Metra, Roissy en Brie (FR)

(73) Assignee: Fors France, Champigny sur Marne (FR)

( * ) Notice: Subject to any disclaimer, the term of this patent is extended or adjusted under 35 U.S.C. 154(b) by 0 days.

(21) Appl. No.: 18/003,880

(22) PCT Filed: Jul. 2, 2021

(86) PCT No.: PCT/FR2021/051217
§ 371 (c)(1),
(2) Date: Dec. 29, 2022

(87) PCT Pub. No.: WO2022/003302
PCT Pub. Date: Jan. 6, 2022

(65) Prior Publication Data

US 2023/0255366 A1 Aug. 17, 2023

(30) Foreign Application Priority Data

Jul. 3, 2020 (FR) ..... 2007078

(51) Int. Cl.
*A47F 5/08* (2006.01)
*A47F 1/12* (2006.01)

(52) U.S. Cl.
CPC ..... *A47F 5/0861* (2013.01); *A47F 1/128* (2013.01); *A47F 5/0807* (2013.01)

(58) Field of Classification Search
CPC ..... A47F 5/0861; A47F 5/0807; A47F 1/128; A47F 5/0006; A47F 5/0823; A47F 5/0876; A47F 5/0838; E05B 69/006
(Continued)

(56) References Cited

U.S. PATENT DOCUMENTS 1,203,809 A * 11/1916 Swikard ..... E05B 69/006 211/7
3,419,154 A * 12/1968 Shapiro ..... A47F 7/24 211/124

(Continued)

FOREIGN PATENT DOCUMENTS

CA 3033926 A1 * 8/2020
FR 3112070 A1 * 1/2022 ..... A47F 5/0861

(Continued)

OTHER PUBLICATIONS

International Search Report for International Application No. PCT/FR2021/051217 dated Aug. 27, 2021, 2 pages.

(Continued)

*Primary Examiner* — Jennifer E. Novosad
(74) *Attorney, Agent, or Firm* — TraskBritt

(57) ABSTRACT

A system for presentation and sale of self-service items comprises a peg configured to be attached to a vertical wall of a retail display unit. The peg is configured to retain items in packaging having a hole therein for the passage of the peg. The peg comprises a smooth rod with a section less than or equal to the section of the hole over a length of the rod configured to receive the packaging, and a notched free end section. The system further includes spacers formed by rings. Each ring has a lumen of section complementary to that of the rod and greater than the section of the notched free end, and at least one tooth configured to be disengaged by an external actuating mechanism to interact at rest with (Continued)

the notching. Each ring has an outer section greater than the section of the hole in the packaging.

13 Claims, 8 Drawing Sheets

(58) Field of Classification Search
USPC ..... 211/7, 57.1, 59.1
See application file for complete search history.

(56) References Cited

U.S. PATENT DOCUMENTS 4,289,242 A * 9/1981 Kenyon ..... A47F 5/0861 211/59.1
4,462,497 A * 7/1984 Maule ..... A47F 5/04 211/70.6
5,259,220 A * 11/1993 Fredrickson ..... A47F 5/0861 70/52
5,275,027 A * 1/1994 Eklof ..... A47F 5/0861 70/38 A
5,509,542 A * 4/1996 Simmerman ..... A47G 25/0692 211/124
5,624,040 A 4/1997 Hono
5,676,258 A * 10/1997 Leyden ..... A47F 5/0861 248/221.11
5,676,268 A 10/1997 King
6,474,478 B1 * 11/2002 Huehner ..... A47F 5/0861 211/4
6,622,979 B2 * 9/2003 Valiulis ..... A47F 5/0861 70/57.1
7,197,902 B1 * 4/2007 Barkdoll ..... A47F 5/0861 70/57.1
7,392,673 B2 * 7/2008 Fawcett ..... E05B 47/004 70/57.1
8,286,454 B2 * 10/2012 Richardson ..... E05B 73/00 70/57.1
8,307,995 B2 * 11/2012 Surma ..... E05B 47/004 70/57.1
8,387,808 B2 * 3/2013 Radowski ..... A47G 25/1464 211/123
8,523,012 B2 * 9/2013 Richardson ..... A47F 5/0861 70/57.1
8,684,227 B2 * 4/2014 Richardson ..... A47F 5/0823 70/57.1
9,435,144 B2 * 9/2016 Bullwinkel ..... E05B 67/36
9,675,184 B2 * 6/2017 Xin ..... A47F 1/128
9,820,587 B1 * 11/2017 Cheng ..... A47F 5/0823
10,111,540 B2 * 10/2018 Brej ..... A47F 1/128
10,694,871 B1 * 6/2020 Vogler ..... A47F 5/0861
11,154,143 B2 * 10/2021 Ewing ..... G08B 13/22
11,403,906 B2 * 8/2022 Hua ..... F16D 63/006
2001/0013567 A1 8/2001 Valiulis
2009/0057244 A1 * 3/2009 Conti ..... A47F 5/0861 211/7
2009/0095695 A1 * 4/2009 Moock ..... A47F 5/0861 211/57.1
2010/0206825 A1 * 8/2010 Johnston ..... A47F 5/0869 248/220.21
2010/0223965 A1 * 9/2010 Richardson ..... E05B 47/004 70/58
2012/0253508 A1 * 10/2012 Holmes ..... A47F 1/128 700/232
2013/0105419 A1 * 5/2013 Kologe ..... A47F 5/0861 211/7
2016/0281393 A1 * 9/2016 Bullwinkel ..... E05B 67/36
2023/0059326 A1 * 2/2023 Ewing ..... A47F 1/128
2023/0255366 A1 * 8/2023 Bouan ..... A47F 5/0861 211/7

FOREIGN PATENT DOCUMENTS

WO 2009/051998 A1 4/2009
WO WO-2022003302 A1 * 1/2022 ..... A47F 5/0861

OTHER PUBLICATIONS

International Written Opinion for International Application No. PCT/FR2021/051217 dated Aug. 27, 2021, 5 pages.

* cited by examiner

SYSTEM FOR PRESENTATION OF SELF-SERVICE ITEMS

CROSS-REFERENCE TO RELATED APPLICATIONS

This application is a national phase entry under 35 U.S.C. § 371 of International Patent Application PCT/FR2021/051217, filed Jul. 2, 2021, designating the United States of America and published as International Patent Publication WO 2022/003302 A1 on Jan. 6, 2022, which claims the benefit under Article 8 of the Patent Cooperation Treaty to French Patent Application Serial No. FR2007078, filed Jul. 3, 2020.

TECHNICAL FIELD

The present disclosure relates to the field of arrangements for the presentation and sale of self-service items, on pegs to be attached to a vertical wall of a retail display unit, often by a cantilevered fastening engaging a perforated or grooved panel, allowing the organization of the retail display unit to be easily reconfigured.

BACKGROUND

To make shoplifting more difficult, it is known to protect items presented in anti-theft boxes that are difficult to open for a person who does not have the ad-hoc unlocking tool, and containing a detection marker, for example, a tuned induction loop or a ferrite causing an alarm to be triggered in the event of passage between a gantry placed in the passage downstream of the cash registers.

New forms of shoplifting have appeared, more brutal and expeditious, intended to feed, in particular, parallel resale circuits, involving tearing all the items from the peg and fleeing quickly without leaving time to spot the thief. This type of theft is justified even if the unit value of each of the items is low, as the stolen collection of items is then resold individually on parallel distribution networks.

To combat this new practice, it has been proposed to reinforce the anchoring of the pegs on the retail display unit and to slow down the withdrawal of the item presented at the front of the peg, to prevent the withdrawal of the entire line of items, while preserving the unit withdrawal of an item. Solutions have been implemented on special pegs requiring mandatory action by the person wishing to take products from the peg. Performing this action requires an elongated product removal duration.

In the state of the art, there are numerous solutions for display racks with pegs, fastened to a slatted wall or a grooved wall, a metal grid, a bar support or a perforated panel. Using a peg matrix on the display rack provides an esthetically pleasing and organized display area that allows potential buyers to view merchandise items without the assistance of sales personnel. Typically, merchandise items are kept in transparent packaging or in a transparent secure container ("blister") or in a transparent anti-theft box, configured to hang on a peg. For "high-risk" items, it is known to provide a series of S-bends adjacent to the free end of the support rod to prevent a shoplifter from "sweeping" all the items in the display. It is also known to provide a mechanical delay mechanism adjacent to the free end of the support rod to increase the time required to dispense each merchandise item from the display hook. It is also known to provide the presentation hook with a locking device configured to be positioned on the support rod between the free end and at least one of the merchandise items.

Patent application WO2009051998 discloses a solution implementing two bars, one of which supports the items and the other of which is intended for hinging two pivoting locks forming a stop to block the advancement of an item suspended from the lower bar. This solution uses a set of rods and time-lock arms. The time-lock arms can be sequentially moved to allow a potential buyer to manipulate an item above the arms so as to detach the item from the display hook. The time-lock arms comprise a guide tube slidably placed on the rod assembly, a first arm being rotatably mounted on the guide tube and a second arm spaced apart from the first arm being fixedly mounted on the guide tube. The first arm is sufficiently spaced apart from the second arm to allow at least one of the items to be placed between the arms. The first arm has a circumferentially extending groove and the guide tube has a key.

Patent application US2001013567 discloses a locking hook assembly for securely displaying goods on a vertical support. The locking hook assembly generally comprises a mounting bracket structured for connection to the vertical support. A hook of generally circular cross-section has an inner end fixed to the mounting bracket and projects outwardly therefrom to an outer end. The outer end of the hook has a reduced diameter portion of generally semi-circular cross-section, and the reduced diameter portion comprises a recess. To prevent removal of merchandise at the outer end, a lock has a semi-circular opening shaped to receive the reduced diameter portion and selectively engage the recess.

Another solution is described in U.S. Pat. No. 5,676,268 that includes an elongated support member with a structure for fixedly attaching the elongated support member to a base in one position. The elongated support member has an entry end that can be directed through an opening in an item to be displayed so as to allow the item to be placed and to slide lengthwise along the length of the elongated support member. A structure is provided on at least one of the elongated support member and a base to which the elongated support member is fixedly attached in the display position to limit the movement of an item to be displayed guidingly along the length of the elongated support member in one direction.

U.S. Pat. No. 5,624,040 discloses a security system for a display rack in which merchandise in packages is threaded through an opening in the packaging over the free end of a hanger rod for display. The free end of the hanger rod is threaded, and a threaded cap is treated onto the free end of the rod to prevent removal of the package. The cap has a pair of opposed grooves, and a special key is provided to remove the cap.

BRIEF SUMMARY

In order to remedy the drawbacks of the solutions of the prior art, the present disclosure relates, according to its most general meaning, to a system for the presentation of self-service items made up of at least one peg intended to retain items whose packaging has a hole for the passage of the peg. The at least one peg is made up of a smooth rod with a section less than or equal to the section of the hole over the length for receiving the packages. The rod has a notched free end section. The system further comprises spacers formed by rings having: a lumen of section complementary to that of the rod and greater than the section of the notched free end, and at least one blade that can be disengaged by an external actuating means to interact at rest with the notching. The ring has an outer section greater than the section of the packaging hole.

According to a first variant, the rings are made up of hollow bodies, and the tooth is made up of a flexible blade curved in the shape of an "L" with a fixed end extending longitudinally and a movable end whose edge is able to engage at rest between two notches of the notched area of the peg.

According to a second variant, the movable end extends in a plane inclined with respect to the transverse plane of the body, to come into abutment against the rear face of the notches during the exertion of a force on the ring in the direction of the free end of the peg on which it is threaded, the actuating means being made up of a movable member whose inner end separates the edge from the movable end when pressure is exerted on its outer part.

According to another variant, the rings are made up of disengageable nuts, and the pegs are made up of rods having a threaded free end section.

Preferably, the nuts contain an axially movable flyweight, pushed at rest against the rear face of the ring and having a seat for attaching the fixed end of at least one flexible blade, the movable end of which extends in a transverse plane, the edge coming to engage at rest in the bottom of the thread, the nuts further comprising a release bearing blocking the movable end of the blade when the flyweight is pushed backwards and a clearance freeing the end of the blade when the flyweight is pushed forward from the ring, the outer surface of the body constituting the actuating means, acting by rotation.

According to a variant, the movable blade is replaced by at least one ball that engages in the thread.

Advantageously, the notched or threaded section is made up of a hollow part engaged on the end of a smooth peg.

According to one embodiment, the longitudinal axis of the notched or threaded section forms an angle with the longitudinal axis of the rear part of the peg.

According to another embodiment, the notched or threaded section is extended by a smooth section.

According to a first variant, the rings are integrated into an anti-theft box.

According to a second variant, the rings are integrated into the packaging of the item.

The present disclosure also relates to an anti-theft box intended to equip a system for the presentation of self-service items made up of a network of pegs intended to retain items whose packaging has a hole for the passage of the peg and whereof the pegs are made up of cylindrical rods having a notched free end section, characterized in that it has a hole for the passage of a peg, the hole being extended by a ring having at least one tooth that can be disengaged by an external actuating means.

The present disclosure also relates to a ring intended to equip a system for the presentation of self-service items made up of a network of pegs intended to retain items whose packaging has a hole for the passage of the peg and whereof the pegs are made up of cylindrical rods having a notched free end section, characterized in that the packaging has a hole for the passage of a peg, the hole being extended by a ring having at least one tooth that can be disengaged by an external actuating means.

The present disclosure relates to a peg intended for a system for the presentation of self-service items intended for items whose packaging has a hole for the passage of the peg and spacers formed by rings having at least one tooth that can be disengaged by an external actuating means, the ring having an external cross-section greater than the cross-section of the hole, characterized in that the peg is made up of a cylindrical rod having a notched free end section.

Advantageously, the system comprises an anti-theft device comprising a ball lock, by way of a nail added or integrated into the system. This nail can be retractable.

It may also comprise a hanger via a housing arranged to receive the system.

It may also comprise a lockable retaining means that is positioned on one of the wires of an adjustable cable lock known as a "spider" (trade name). This hook integrating the system allows hanging on a peg.

According to a variant, the rings have a complementary locking means of an anti-theft tag.

According to a variant, the rings have a housing for engaging a hanger.

According to a variant, the rings have an additional locking means for an adjustable cable lock for hanging products secured by the cable lock.

BRIEF DESCRIPTION OF THE DRAWINGS

The present disclosure will be better understood on reading the following description, which concerns non-limiting embodiments illustrated by the appended drawings, in which.

DETAILED DESCRIPTION

Figure 1:
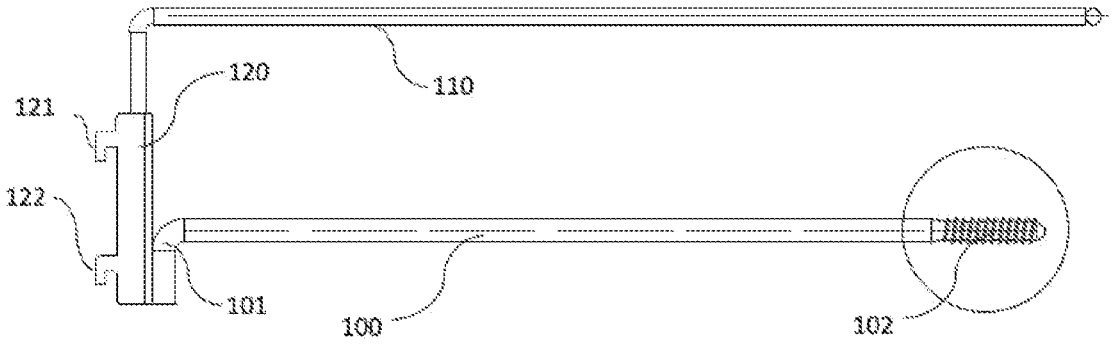
FIG. 1 shows a front view of a peg according to the present disclosure.

The delay function in retrieving the item is obtained by the time made necessary corresponding to setting the button integrating the disengageable nut in rotation.

The release path of the item is obtained by a spiral-shaped path (thread) present on the peg supporting the items. The movement of the button is achieved owing to the interaction of a complementary thread present therein. In the variant described below, this thread is for example, in the form of three blades, in particular, metallic, placed at 120°.

This configuration is not limiting: the number of blades can be different, for example, a single blade or a larger set of blades, and the orientation can be different.

Similarly, the blades can be made from a material other than metal.

To enable the button to perform the delay function and the disengagement function, these blades have an axial degree of freedom relative to that of the peg. To allow simultaneous movement of the 3 blades, they have been associated by way of an additional part called a flyweight. The blades are held in position in the flyweight by snap-fastening, for example.

In order to optimize the interaction of the blades with the thread of the peg, a blade tip offset was made based on the pitch of the peg thread.

This offset is also present in the positioning of the release bearings in order to optimize the blocking of the blades in the delay mode. In order to switch automatically from delay mode to release mode, a spring has been associated with this function. This degree of freedom will allow the blades to move in 2 distinct areas.

The release area inside the button will allow the blade to be able to move freely in a dedicated housing when sliding (mounted) on the threads of the peg. The movement of the flyweight in this area is the result of the pressure exerted by the blades on the thread when the delay button is inserted on the peg. This movement is the result of the movement direction of the peg and the point of contact between the blades and the thread of the peg.

The delay area inside the button does not allow the blade to move freely. Indeed, in this area the space has been removed and replaced by stops leaving only the functional play to the axial movement of the flyweight. The blades therefore cannot slide on the thread; the only way to advance the blades is to make them follow the spiral-shaped path created by the thread. The movement of the flyweight in this area is the result of the action of the spring, which pushes the flyweight backwards.

During an attempted theft, the thief will try to quickly get the product off the peg without following the spiral path of the thread. This gesture of pulling the system forward will help keep the flyweight in position in the delay area by putting the blades under pressure against the thread (point of contact).

The disengageable button can be actuated by blades or balls or any other interaction solution.

The design of the peg must take into account that a sufficient distance between the threaded peg and the price tag support rod (paper or electronic) is ensured in order to guarantee the legibility of the instructions for use of the delay button. The threading area can be made by machining the metal rod, by adding one or more additional parts assembled at the end of the metal rod to adapt the desired delay time. The position and the length of the threaded area will be adapted according to the customer's specifications.

A keying system ensures the perfect positioning of the flyweight equipped with blades or balls in the body of the button, in order to guarantee that each blade is associated with its release bearing.

Each peg performs several functions;

a) The peg serves as a support for the items, the smooth part of the rod (100) allowing the item to be packaged owing to a hole that makes it possible to thread it onto the rod and to hang it, with the possibility of longitudinal sliding up to the removal end passing over the notched area (102);

b) The peg is used to block the items through the interaction of its notched end with spacer rings that block the item "upstream," the section of this ring being greater than that of the hole of the packaging; and c) Each item is separated by a ring ("a spacer ring") that makes it necessary to remove the items one after the other, with a certain lag time between two removals, imposed by the passage of the ring over the notched area.

It is thus impossible to remove a series of items on the peg by a single gesture.

Description of the Peg

The peg shown in FIG. 1 is formed by a rod (100) of round section, for example, the rear end (101) of which is curved and the front end (102) of which is threaded over a length corresponding to the desired delay time. This delay time corresponds to the time required for the unscrewing needed to remove the product from the peg. To reduce or lengthen the delay time, the rod (100) or its threaded end (102) may be interchangeable by replacement by snap-fastening means or at the time of manufacture or by the store manager.

Usually, a second rod (110) is placed in parallel, to support at its front end a display support for designating the item and/or the price. The rear ends of the two rods (100, 110) are engaged in a hooking interface (120) having in the illustrated example two prongs (121, 122) intended for snap-fastening into a perforated or grooved panel.

Figure 2:
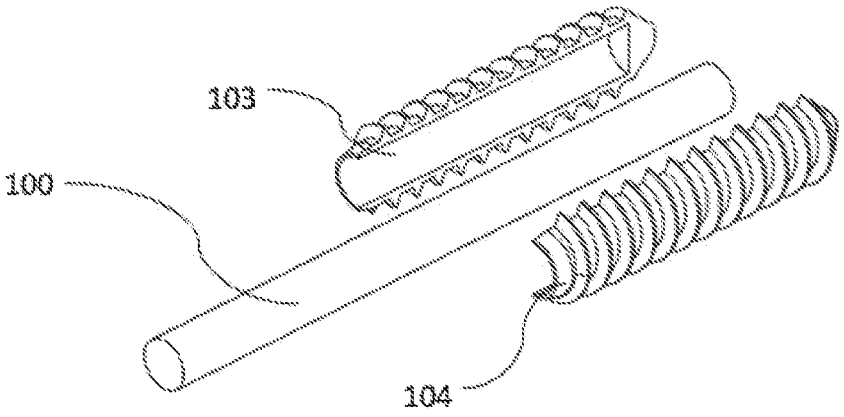
FIG. 2 shows an exploded view of the free end of a peg according to the present disclosure.

FIG. 2 illustrates an embodiment of the peg by assembly, at the free end of the rod (100), of two threaded half-shells (103, 104), fixed by gluing, welding or snap-fastening.

Packaging of Items

Figure 3:
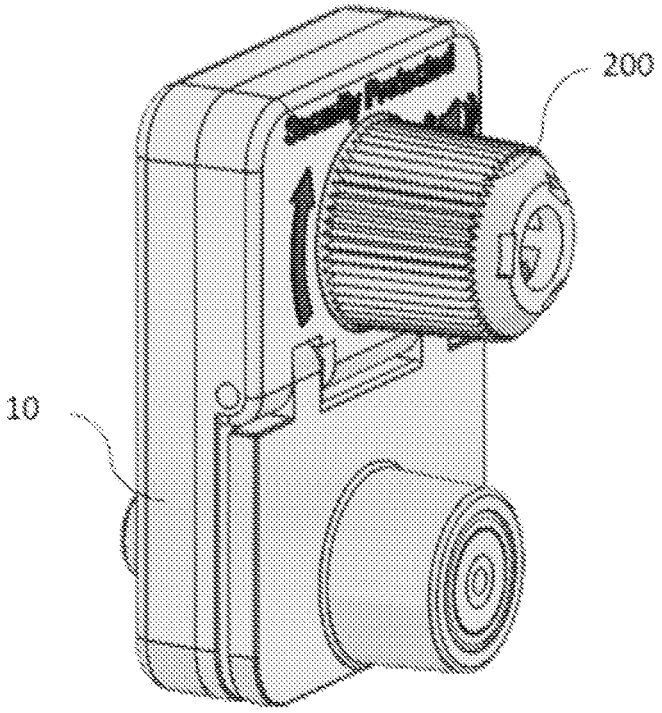
FIG. 3 shows a perspective view of an anti-theft box according to the present disclosure.
Figure 4:
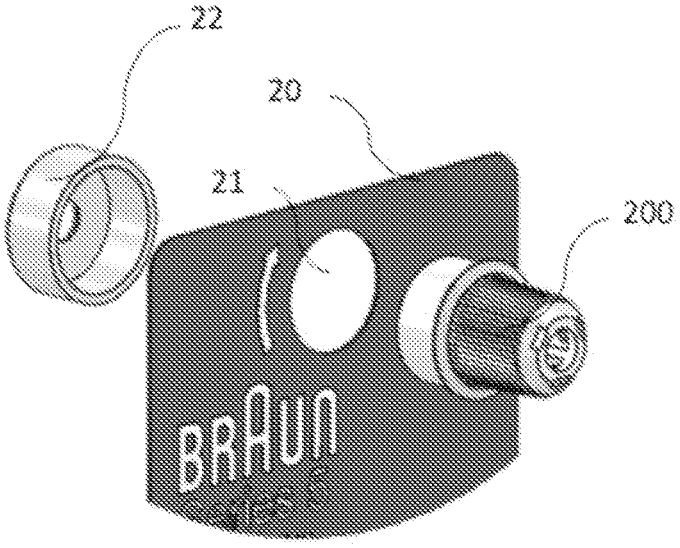
FIG. 4 shows a perspective view of an anti-theft blister pack according to the present disclosure.

The items are placed in an anti-theft retaining system (10) associated with an anti-theft box shown in FIG. 3 or packaged with a blister pack (20) shown in FIG. 4. The packaging (10, 20) has a hole (21) allowing storage on a peg (100), surrounded by a ring (200). A crimping piece (22) secures the ring (200) to the blister pack (20).

It is also possible to provide items with packaging simply pierced to allow positioning on the peg (100), alternating them with rings (200). The ring (200) can also have a retractable nail or an added nail in order to associate an anti-theft tag with a ball lock.

Detail of the Ring (200)

Figure 5:
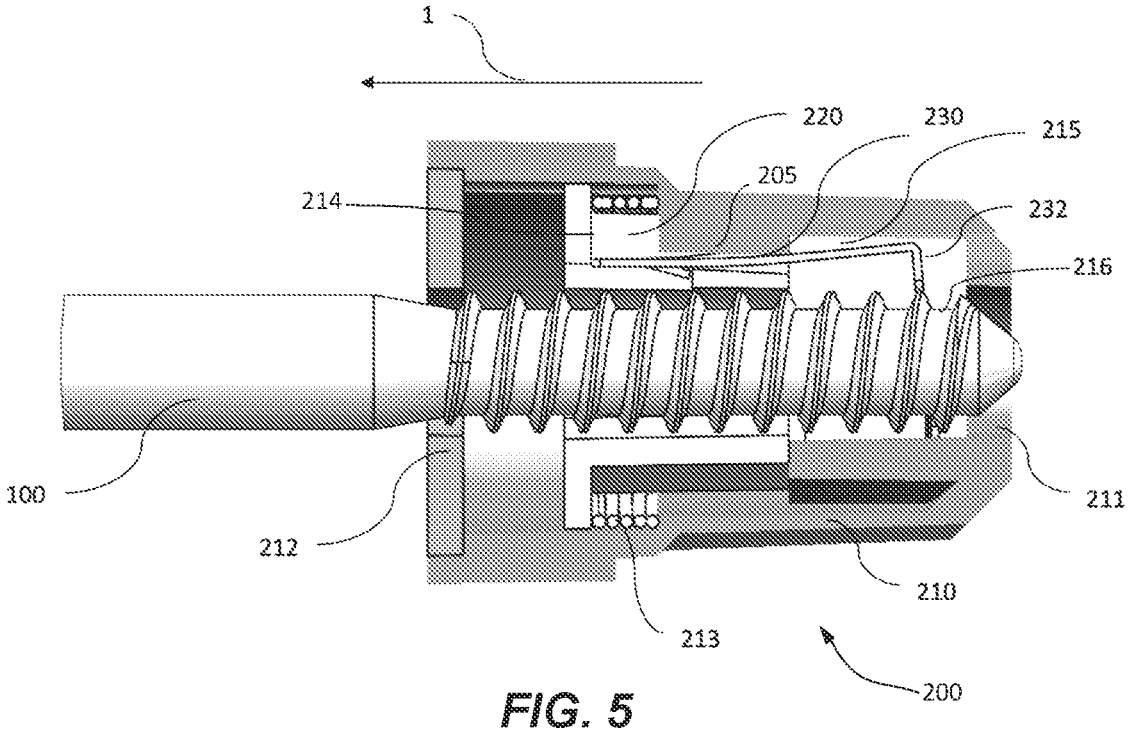
FIG. 5 shows a sectional view of a disengageable nut according to the present disclosure, in the peg loading phase.
Figure 6:
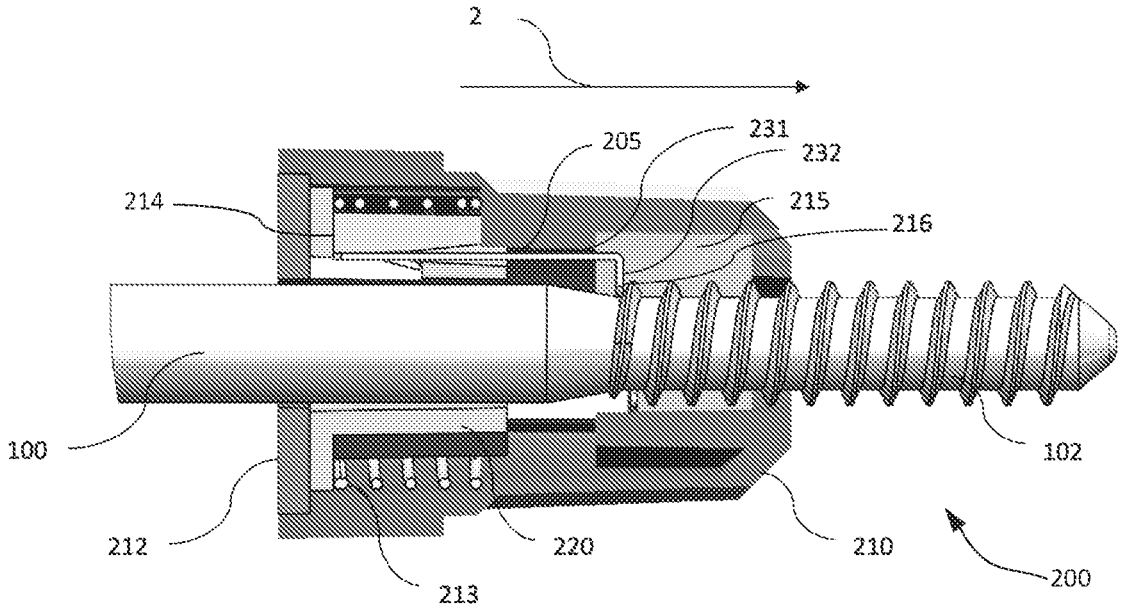
FIG. 6 shows a sectional view of a disengageable nut according to the present disclosure, during the removal phase of an item from the peg.
Figure 7:
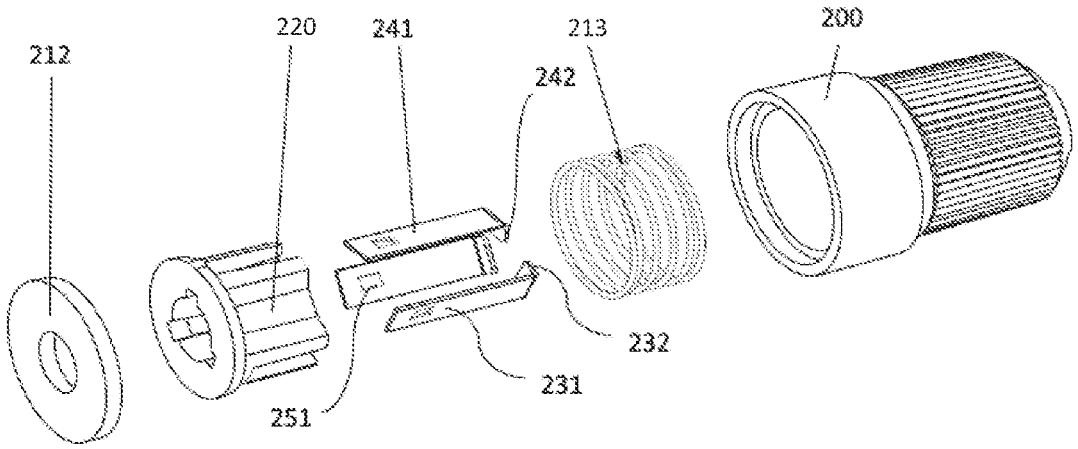
FIG. 7 shows an exploded view of a disengageable nut according to the present disclosure.
Figure 8:
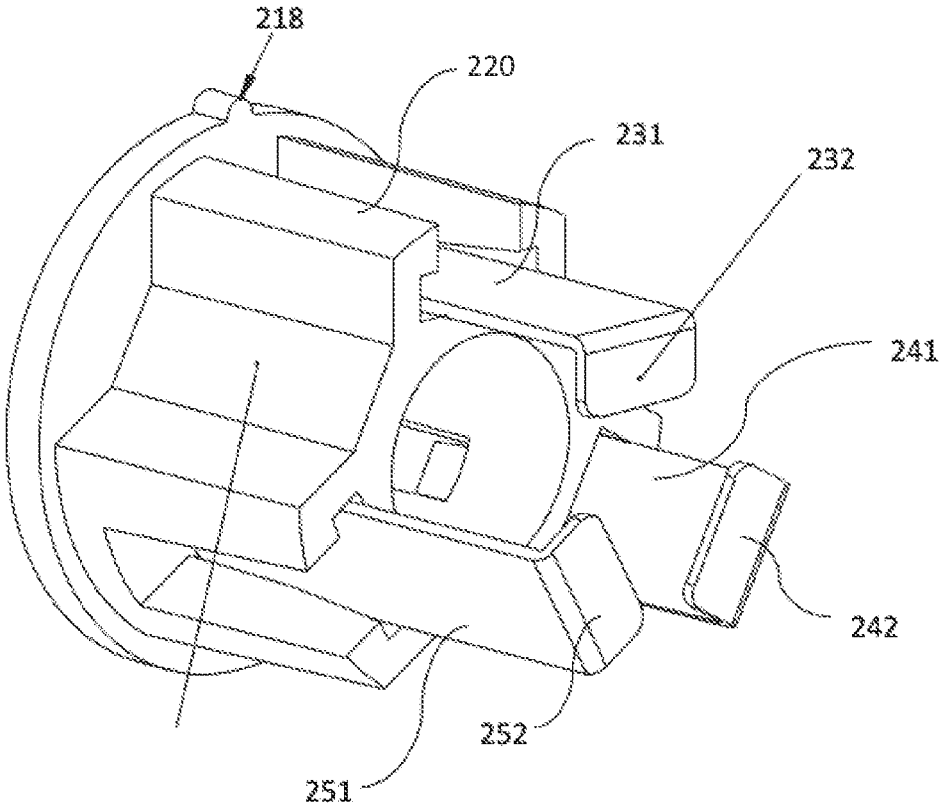
FIG. 8 shows a perspective view of the flyweight of a disengageable nut according to the present disclosure.

FIGS. 5 and 6 show sectional views of an embodiment of a ring (200), respectively, in the engagement phase on the peg, where pressure is exerted on the front face of the items in the direction of the arrow (1), and in the removal phase of an item, where the movement relative to the peg is in the direction of the arrow (2).

The ring comprises a hollow body (210) made of plastic material, of cylindrical shape, opening at the front by an opening (211) of section complementary to the section of the peg (100) and closed at the rear by a pierced membrane seal (212).

It contains a tubular flyweight (220) pushed against the rear membrane seal (212) by a spring (213) bearing against an annular stop (214) provided in the front part of the hollow body (210). The flyweight secures three flexible blades (230) having an "L" shape with a rear part (231, 241, 251) extending in a longitudinal plane and a front part (232, 242, 252) extending in a transverse plane. The transverse edge of the front parts (232, 242, 252) comes into contact with the surface of the peg (100), and, in particular, of the threaded part (102) at the start of engagement of the item. A stop (205) limits the flexion of the rear part (231) of the flexible blade.

During the engagement of a series of items on the peg, the pressure exerted in the direction of the arrow by the end (232, 242, 252) of the blades (230) coming into contact with the thread (102) pushes the flyweight (220) back into the hollow body (210) by compressing the spring (213). In this position, the clearance (215) allows the blades (230) sufficient flexion to free the passage of the thread (102).

When removing an item, the pressure exerted in the direction of arrow 2 by the contact of the end (232, 242, 252) of the blades (230) with the thread (102), combined with the pressure of the spring, pushes the flyweight (220) against the pierced membrane seal (212). In this position, the blades (230) do not have freedom of movement in the clearance (215). Indeed, the stop prevents any bending of the blades, preventing axial movement of the ring (200).

However, by turning the hollow body, unscrewing is caused, which makes it possible to advance the hollow body (210) and the flyweight (220), provided with a protuberance (218) serving as position keying for the flyweight (220), until it passes the threaded part (102).

Variant Embodiment

Figure 9:
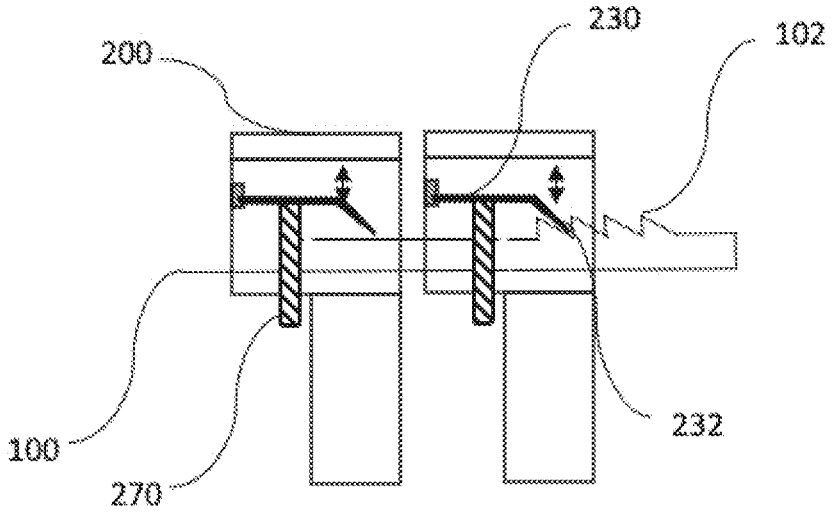
FIG. 9 shows a schematic view of a ring according to a variant of the present disclosure.
Figure 10:
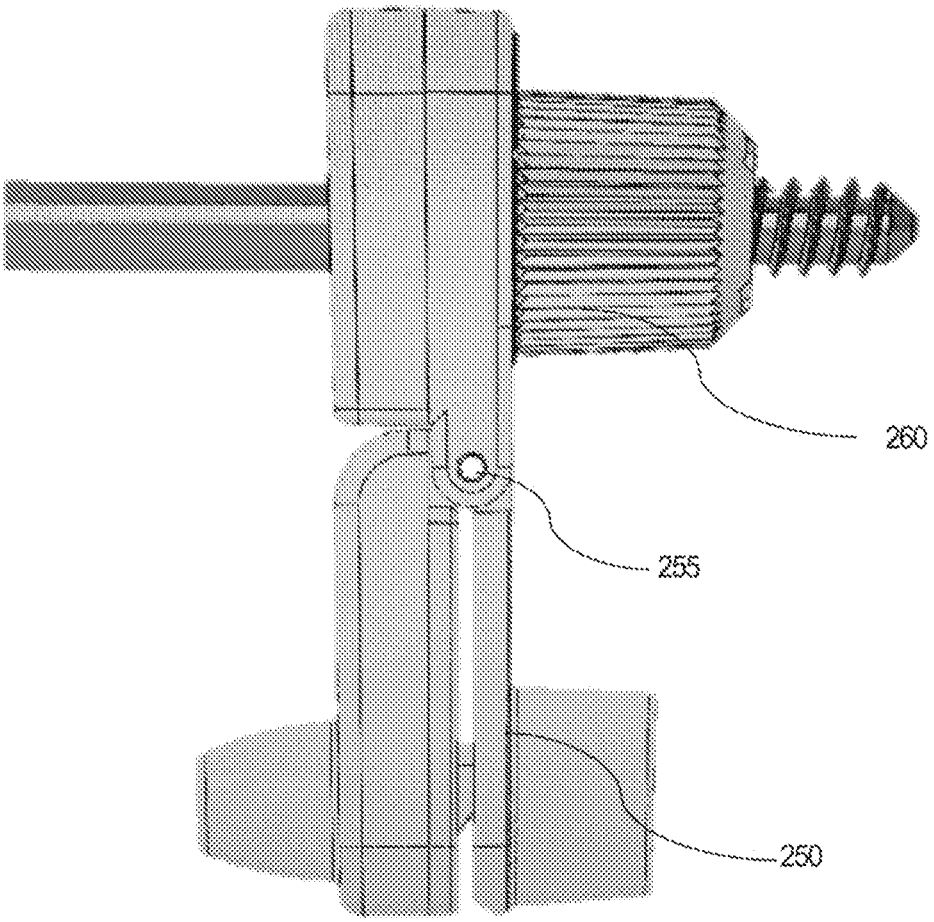
FIG. 10 shows a schematic side view of a variant of the present disclosure.
Figure 11:
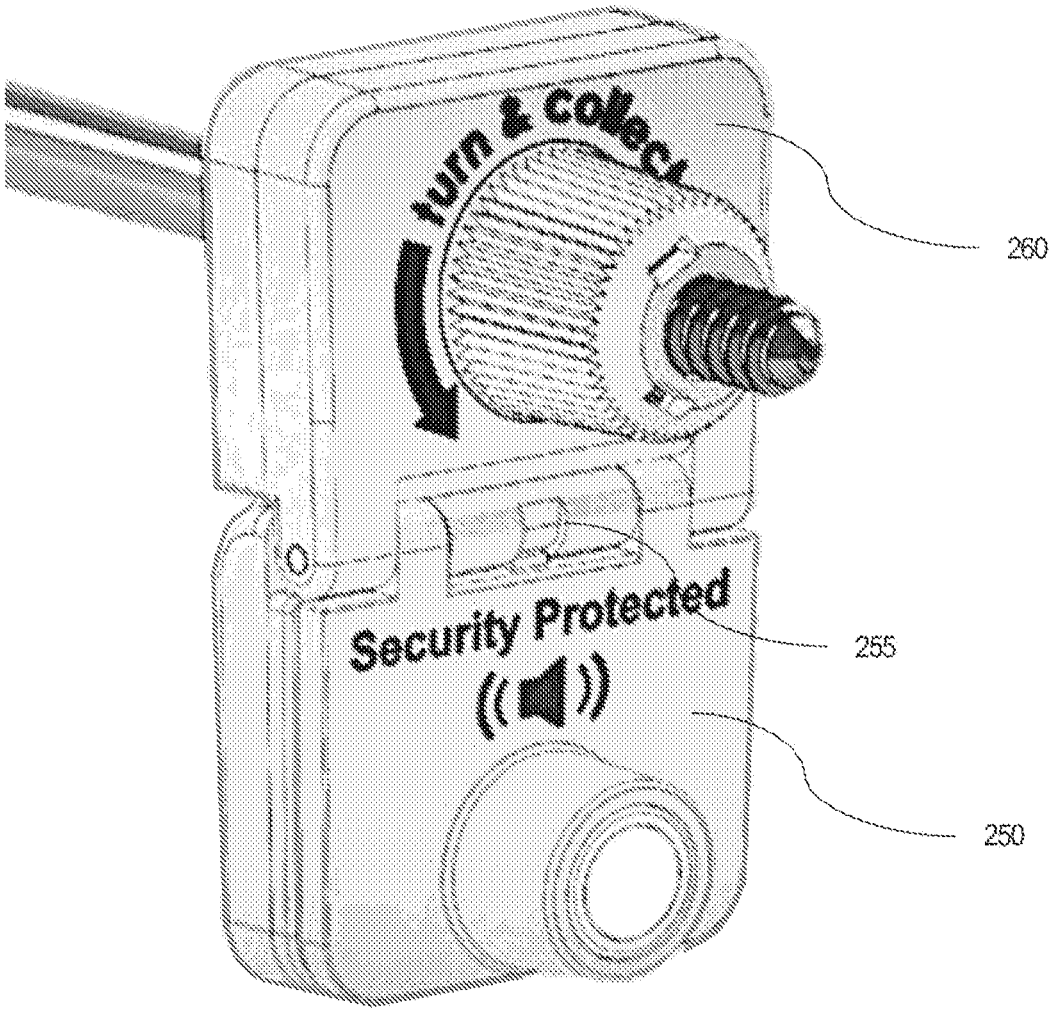
FIG. 11 shows a schematic perspective view of a variant of the present disclosure.

FIG. 9 schematically illustrates an alternative embodiment where the peg (100) has a notched front end. The flexible blade (230) has a front part inclined with respect to the transverse plane. This inclination ensures an elastic deformation when the ring (200) is engaged on the peg (100) and pushed away from the free end (102), for bulk loading of the items.

Removal requires pushing back the flexible blade (230) using a button (270), which requires the customer to activate a single item at a time, the last item placed before the notched area (102).

Association of a Delay Device with an Anti-Theft Device

The present disclosure can be added to any existing anti-theft device by way of a hinged area.

Figure 12:
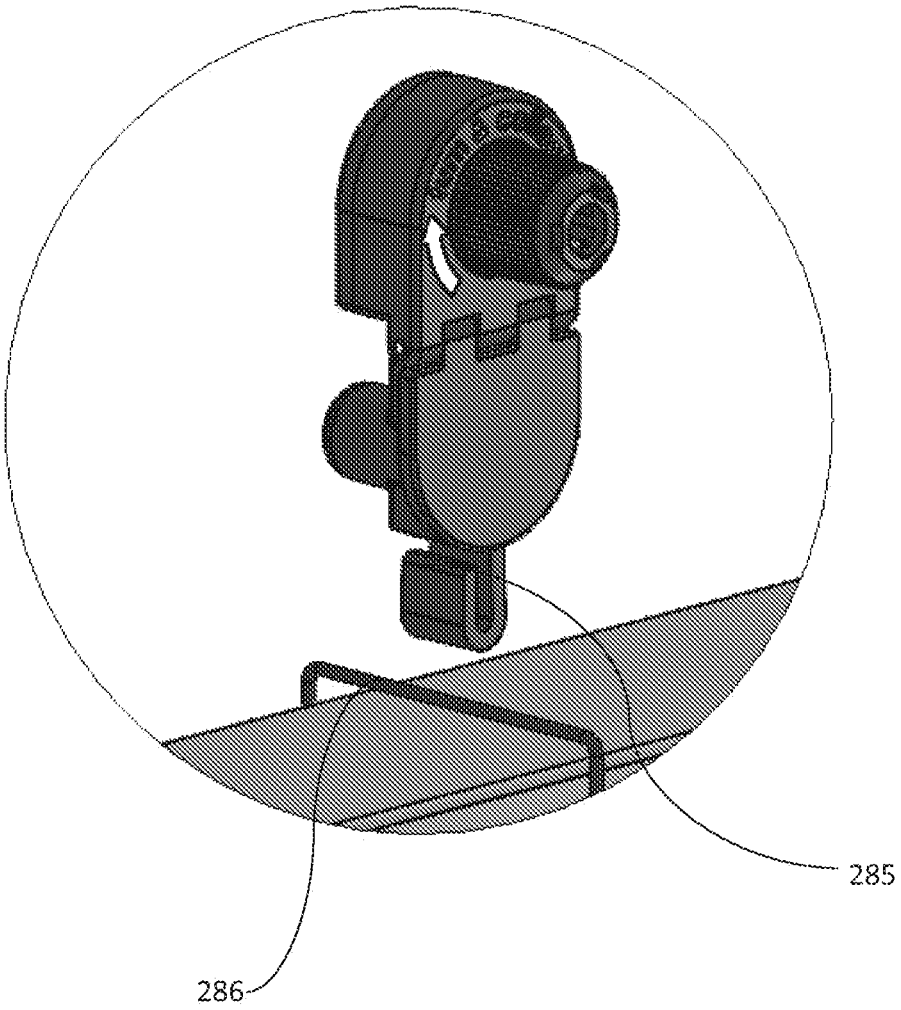
FIG. 12 shows a detail view of a variant of the present disclosure.
Figure 13:
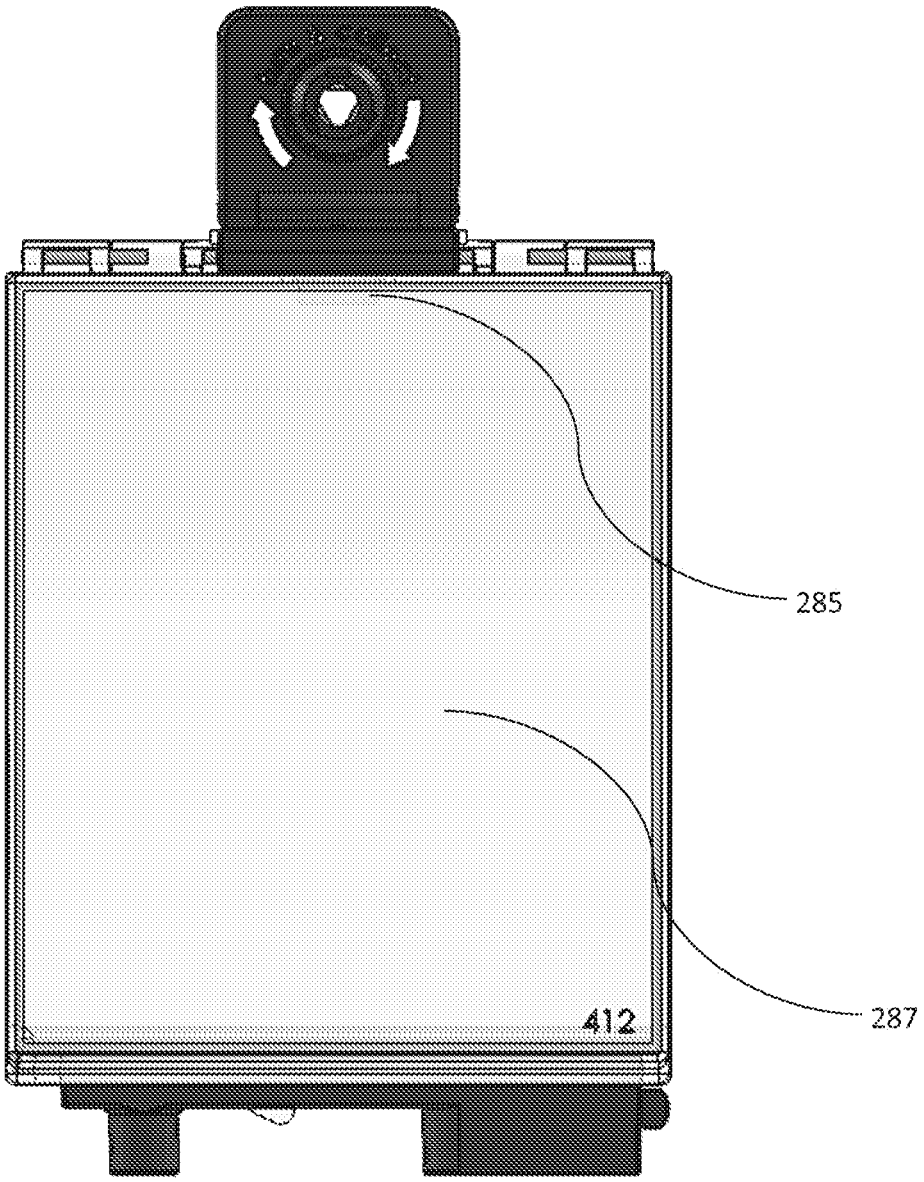
FIG. 13 shows a perspective view of another variant of the present disclosure.

By way of example, FIG. 12 illustrates an embodiment where the anti-theft device actuates a hook (285) suitable for attaching a strap (286) surrounding the protected item. This strap (286) can in turn be secured by an anti-theft box of the "security spider" type. By way of example, FIG. 13 illustrates another embodiment where the anti-theft device actuates a hook (285) able to attach to an anti-theft box (287) surrounding the protected item.

The invention claimed is:

1. A system for presenting self-service items, comprising:

a peg configured to retain items in packaging, the packaging having a hole therein for passage of the peg, the peg comprising a smooth rod section, the smooth rod section having a cross-sectional dimension less than or equal to a cross-sectional dimension of the hole, the smooth rod section being configured to receive the items in packaging via the hole of the packaging, and the peg comprising a notched free end; and a spacer associated with each of the items, the spacer being formed by a ring, the ring comprising:

a lumen configured to interface with the smooth rod section, the lumen having a cross-sectional dimension greater than a cross-sectional dimension of the notched free end, and at least one tooth configured to be biased into engagement with the notched free end and to be disengaged from the notched free end by an external actuating mechanism; and wherein the ring has an outer cross-sectional dimension that is greater than the cross-sectional dimension of the hole in the packaging.

2. The system of claim 1, wherein the ring comprises a hollow body, and wherein the at least one tooth comprises a flexible blade having an "L" shape with a fixed end extending longitudinally and a movable end, the movable end having an edge configured to rest between two notches of the notched free end of the peg.

3. The system of claim 2, wherein the movable end of the flexible blade extends in a plane inclined with respect to a transverse plane of the hollow body to come into abutment against a rear face of one of the two notches during an exertion of a force on the ring in a direction of the notched free end of the peg on which it is disposed, wherein the external actuating mechanism comprises a movable member having an inner end configured to separate the edge from one of the two notches when pressure is exerted on an outer part of the movable member.

4. The system of claim 2, wherein the ring comprises a disengageable nut, and the notched free end of the peg comprises a threaded free end.

5. The system of claim 4, wherein the disengageable nut comprises:

an axially movable flyweight, the axially movable flyweight being biased against a rear face of the ring and having a seat for attaching the fixed end of the flexible blade, the movable end of the flexible blade extending in a transverse plane, the edge of the movable end configured to engage the bottom of a thread of the threaded free end;

a stop configured to block the movable end of the flexible blade when the flyweight is pushed backward relative to the hollow body of the ring; and a clearance configured to allow movement of the movable end of the flexible blade when the flyweight is pushed forward relative to the hollow body of the ring, an outer surface of the hollow body defining the external actuating mechanism, and the external actuating mechanism being actuated by rotating the hollow body relative to the peg.

6. The system of claim 1, wherein the notched free end of the peg comprises a hollow member engaged on a smooth end of the smooth rod section.

7. The system of claim 1, wherein a longitudinal axis of the notched free end of the peg is oriented at an angle relative to a longitudinal axis of a rear part of the peg.

8. The system of claim 1, wherein the smooth rod section comprises a smooth section adjacent to the notched free end of the peg.

9. The system of claim 1, wherein the ring is integrated in an anti-theft box.

10. The system of claim 1, wherein the ring is integrated into the packaging of an item.

11. A system for presenting self-service items in a retail setting, comprising:

a peg having a smooth cylindrical section, and a threaded free end section immediately adjacent the smooth cylindrical section; and a ring defining a hole therethrough, the ring comprising an internal moveable member, the internal moveable member configured to enable the threaded free end section of the peg to pass through the hole of the ring and to allow the ring to pass over the threaded free end section and onto the smooth cylindrical section without requiring rotation of the ring relative to the peg, the internal moveable member configured to require rotation of the ring relative to the peg to enable the ring to pass over the threaded free end section and off the peg.

12. The system of claim 11, wherein the ring comprises:

a hollow body having a longitudinal axis extending centrally through the hole;

an internal ring member configured to slide relative to the hollow body between a first position and a second position;

a biasing member disposed within the hollow body and configured to bias the internal ring member toward the first position; and at least one L-shaped element having a first section extending in a direction parallel to the longitudinal axis of the hollow body, the first section fixedly attached to the internal ring member, and a second section oriented perpendicular to the longitudinal axis of the hollow body, the second section configured to interfere with threads of the threaded free end section of the peg when the internal ring member is in the first position, the second section configured to deflect over the threads of the threaded free end section of the peg when the internal ring member is in the second position.

13. The system of claim 12, wherein the hollow body has an internal stop feature configured to prevent deflection of the second section of the at least one L-shaped element when the internal ring member is in the first position, and wherein the hollow body has an internal recessed area into which the second section of the at least one L-shaped element can deflect when the internal ring member is in the second position.

* * * * *